US010094188B1

(12) United States Patent
Smith

(10) Patent No.: US 10,094,188 B1
(45) Date of Patent: Oct. 9, 2018

(54) CASING HANGER AND RUNNING TOOL SYSTEM

(71) Applicant: Jerry D. Smith, Spring, TX (US)

(72) Inventor: Jerry D. Smith, Spring, TX (US)

(73) Assignee: CACTUS Wellhead, LLC, Houston, TX (US)

( * ) Notice: Subject to any disclaimer, the term of this patent is extended or adjusted under 35 U.S.C. 154(b) by 217 days.

(21) Appl. No.: 14/943,984

(22) Filed: Nov. 17, 2015

Related U.S. Application Data

(60) Provisional application No. 62/083,613, filed on Nov. 24, 2014.

(51) Int. Cl.
*E21B 23/01* (2006.01)

(52) U.S. Cl.
CPC ..... *E21B 23/01* (2013.01)

(58) Field of Classification Search
CPC ..... E21B 23/01
See application file for complete search history.

(56) References Cited

U.S. PATENT DOCUMENTS

| | | | | |
|---|---|---|---|---|
| 4,953,617 | A | 9/1990 | Ross et al. | |
| 5,002,131 | A * | 3/1991 | Cromar | E21B 23/01 166/208 |
| 6,065,536 | A | 5/2000 | Gudmestad et al. | |
| 8,528,650 | B1 | 9/2013 | Smith et al. | |
| 2010/0326674 | A1 | 12/2010 | Nguyen et al. | |
| 2015/0041151 | A1 * | 2/2015 | Cocker, III | E21B 33/0415 166/380 |

* cited by examiner

*Primary Examiner* — Sean D Andrish
(74) *Attorney, Agent, or Firm* — Greenberg Traurig, LLP

(57) ABSTRACT

A casing hanger and running tool system and method for rotating a casing string in a borehole include a selectively engageable connection between the casing hanger and the running tool whereby upon rotation of the casing hanger and running tool in a first direction, a length of casing may be rotated without any substantial tightening of a threaded connection between the running tool and the casing hanger, and upon rotation of the running tool in a second direction, the threaded connection between the running tool and the casing hanger may be disengaged.

12 Claims, 3 Drawing Sheets

CASING HANGER AND RUNNING TOOL SYSTEM

RELATED APPLICATION

This Application claims the benefit, and priority benefit, of U.S. Patent Application Ser. No. 62/083,613, filed Nov. 24, 2014, entitled "Casing Hanger and Running Tool System".

BACKGROUND OF THE INVENTION

1. Field of the Disclosure

The invention relates to a casing hanger and running tool system for use with a casing string in casing operations in a borehole of a well for producing hydrocarbons.

2. Description of the Related Art

Various casing hangers and running tools have been previously used in casing operations. When a casing string is run into a well, or borehole, the casing string movement is generally limited to only vertical reciprocating movement. Rotation of the casing string to the right, or in a clockwise direction, is limited due to concerns about applying too much torque to the connections in the casing string.

BRIEF SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one illustrative embodiment, a casing hanger and running tool system may comprise: a casing hanger having an upper and a lower end, an annular-shaped upper wall surface and a first set of internal threads disposed adjacent the lower end of the casing hanger, the set of internal threads adapted to receive a threaded end of a length of casing, and a second set of internal threads disposed on an inner wall surface of the casing hanger, adjacent the upper end of the casing hanger; a running tool having an upper and a lower end, including an annular-shaped projection disposed intermediate the upper and lower ends of the running tool, a set of external threads disposed on an outer wall surface of the running tool, the set of external threads of the running tool being releasably engageable with the second set of internal threads of the casing hanger when the running tool is received within the casing hanger, to provide a threaded connection between the running tool and the casing hanger; and a selectively engageable connection between the casing hanger and the running tool, whereby upon rotation of the casing hanger and running tool in a first direction, the length of casing may be rotated without any substantial tightening of the threaded connection between the running tool and the casing hanger, and upon rotation of the running tool in a second direction, the threaded connection between the running tool and the casing hanger is disengaged.

In another illustrative embodiment, a method for rotating a casing string in a borehole may comprise: providing a casing hanger and running tool system, including: a casing hanger having an upper and a lower end, an annular-shaped upper wall surface and a first set of internal threads disposed adjacent the lower end of the casing hanger, and a second set of internal threads disposed on an inner wall surface of the casing hanger; a running tool having an upper and a lower end including an annular-shaped projection disposed intermediate the upper and lower ends of the running tool, and a set of external threads disposed on an outer wall surface of the running tool; and a selectively engageable connection between the casing hanger and the running tool; attaching the running tool to the casing hanger by disposing the running tool within the casing hanger and providing relative rotational movement between the running tool and the casing hanger to releasably engage the set of external threads of the running tool with the second set of internal threads of the casing hanger to provide a threaded connection between the running tool and the casing hanger; engaging the selectively engageable connection between the casing hanger and the running tool; attaching the casing string to the casing hanger and running tool system by disposing an end of the casing string within the first set of internal threads disposed adjacent the lower end of the casing hanger; and providing a rotational force to the casing hanger and running tool to rotate the casing string without substantially tightening the threaded connection between the running tool and the casing hanger by transmitting the rotational force through the selectively engageable connection.

BRIEF DESCRIPTION OF THE DRAWING

The present casing hanger and running tool system may be understood by reference to the following description taken in conjunction with the accompanying drawing, in which.

Figure 3:
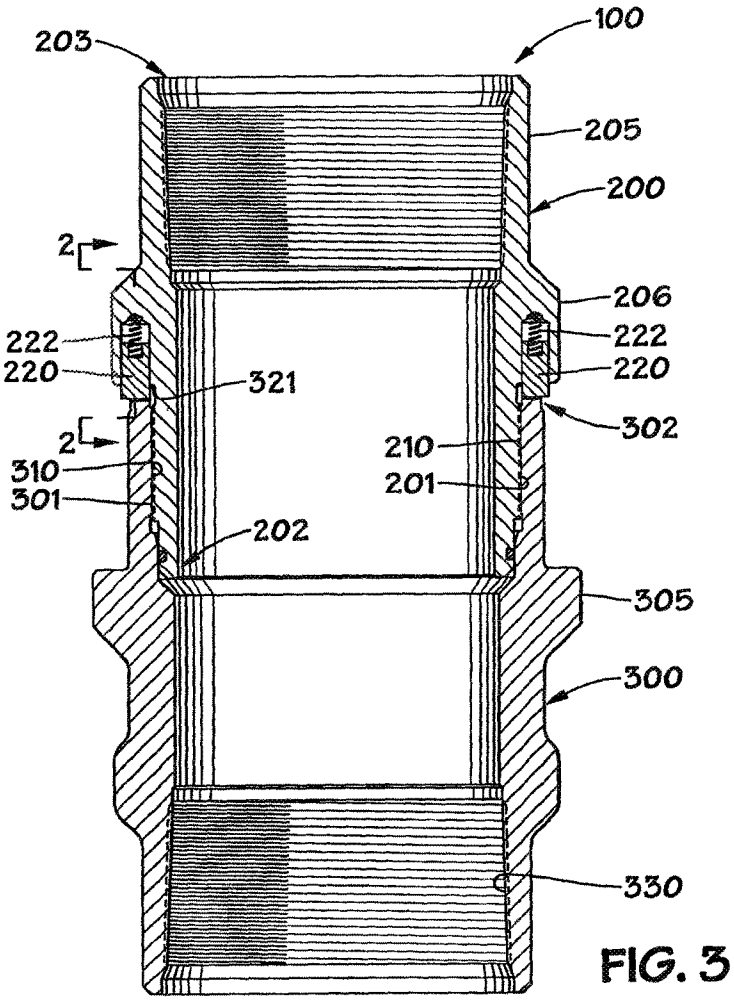
FIG. 3 is a partial cross-sectional view taken along line 3-3 of FIG. 1.

While certain embodiments of the present casing hanger and running tool system will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the drawing figures, which are not to scale, the same reference numerals are used throughout the description and in the drawing figures for components and elements having the same structure, and primed reference numerals may be used for components and elements having a similar function and construction to those components and elements having the same unprimed reference numerals.

DETAILED DESCRIPTION OF THE SPECIFIC EMBODIMENTS

It should be understood that, although an illustrative implementation of one or more embodiments are provided below, the various specific embodiments may be implemented using any number of techniques known by persons of ordinary skill in the art. The disclosure should in no way be limited to the illustrative embodiments, drawings, and/or techniques illustrated below, including the exemplary designs and implementations illustrated and described herein. Furthermore, the disclosure may be modified within the scope of the appended claims along with their full scope of equivalents.

With reference to FIGS. 1-4, an illustrative embodiment of a casing hanger and running tool system 100 is illustrated, which is intended for use in casing operations in a borehole, or well, for the production of hydrocarbons, and generally includes a running tool 200 and a casing hanger 300. The running tool 200 includes an external, right-handed set of pin threads 210 (FIG. 3) on an outer wall surface 201 of running tool 200 proximate its lower end 202. Threads 210 are threadedly engageable with a mating internal right-handed set of box threads 310 (FIG. 3) on, or associated with, an inner wall surface 301 of the casing hanger 300, disposed proximate the upper end 302 of casing hanger 300. Casing hanger 300 preferably includes a set of internal threads 330 (FIGS. 3-4) for receiving the externally threaded, upper end, or male threaded end, of a length of conventional casing 600, which is part of a casing string, or string of casing, suspended from the casing hanger 300. The running tool 200 is releaseably attached, or threadeadly connected, to the casing hanger 300 by the threaded engagement of threads 210 and 310 (FIGS. 3 and 4), upon running tool 200 being received within casing hanger 300, and relative rotational movement being provided between casing hanger 300 and running tool 200.

Figure 1:
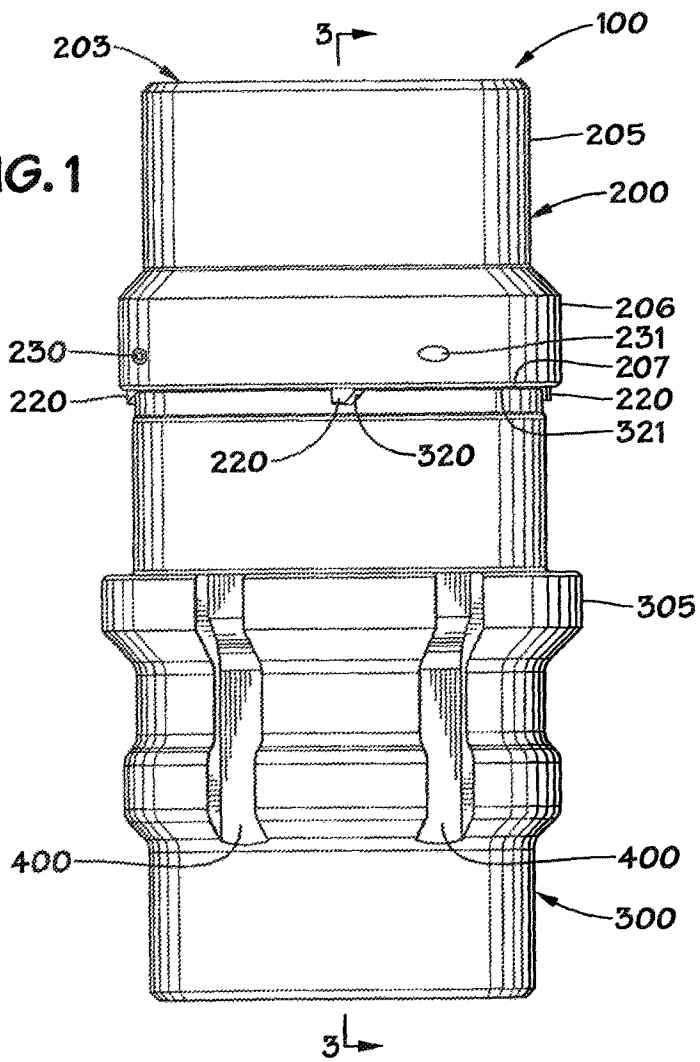
FIG. 1 is a front view of an illustrative embodiment of a casing hanger and running tool of the present system.
Figure 2:
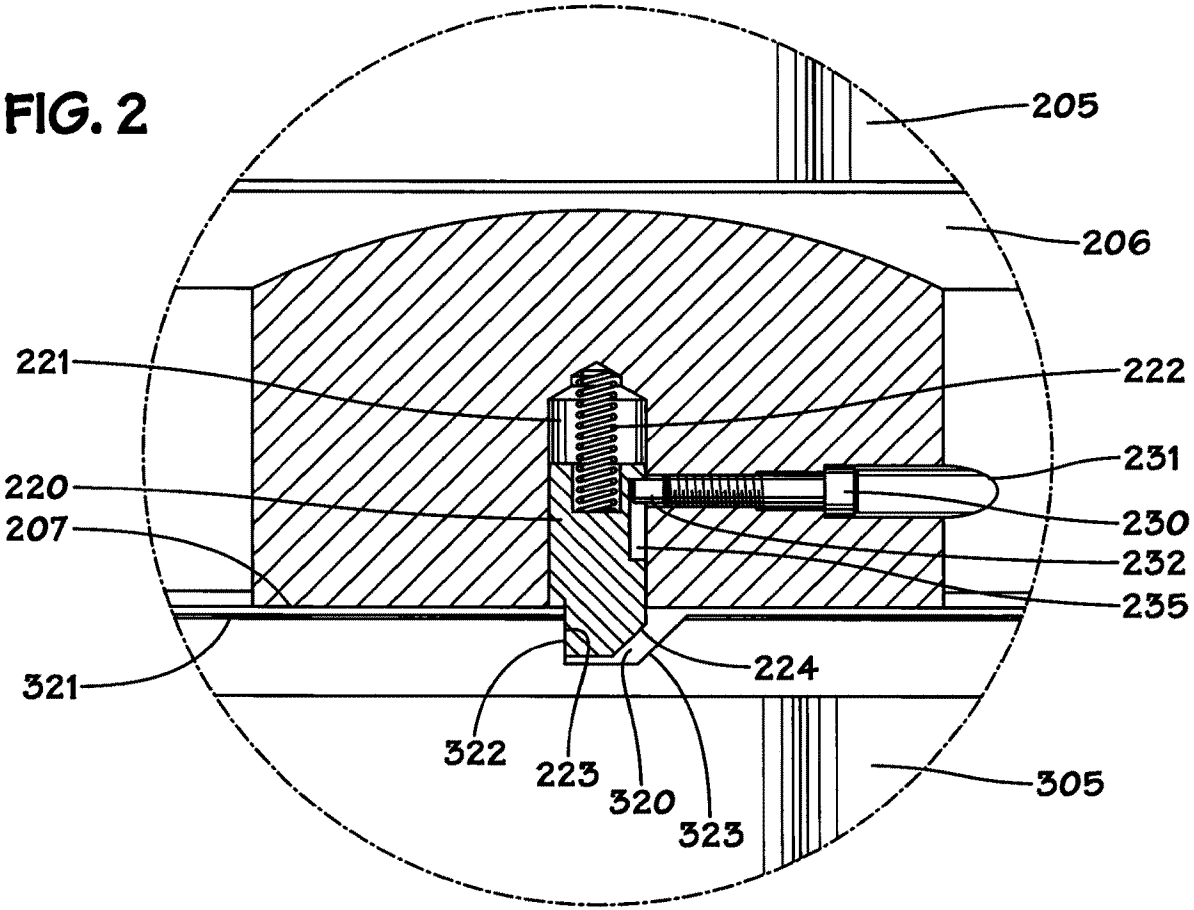
FIG. 2 is an enlarged partial cross-sectional view taken along line 2-2 of FIG. 3 of FIG. 1.

Running tool 200 generally includes a generally cylindrical shaped body member 205 having an annular shaped projection 206 disposed on the outer wall surface 201 of running tool 200, intermediate the lower end 202 and upper end 203 of running tool 200, as seen in FIGS. 1 and 3. Casing hanger 300 generally includes a generally cylindrical shaped body member 305 having an annular-shaped, upper end surface 321 disposed at the upper end 302 of body member 305 of casing hanger 300 as shown in FIGS. 1-3. As shown in FIGS. 1 and 3, body member 305 of casing hanger 300 generally receives body member 205 of running tool 200 with the lower end 207 of projection 206 of running tool 200 abutting the upper end surface 321 of casing hanger 300.

Figure 4:
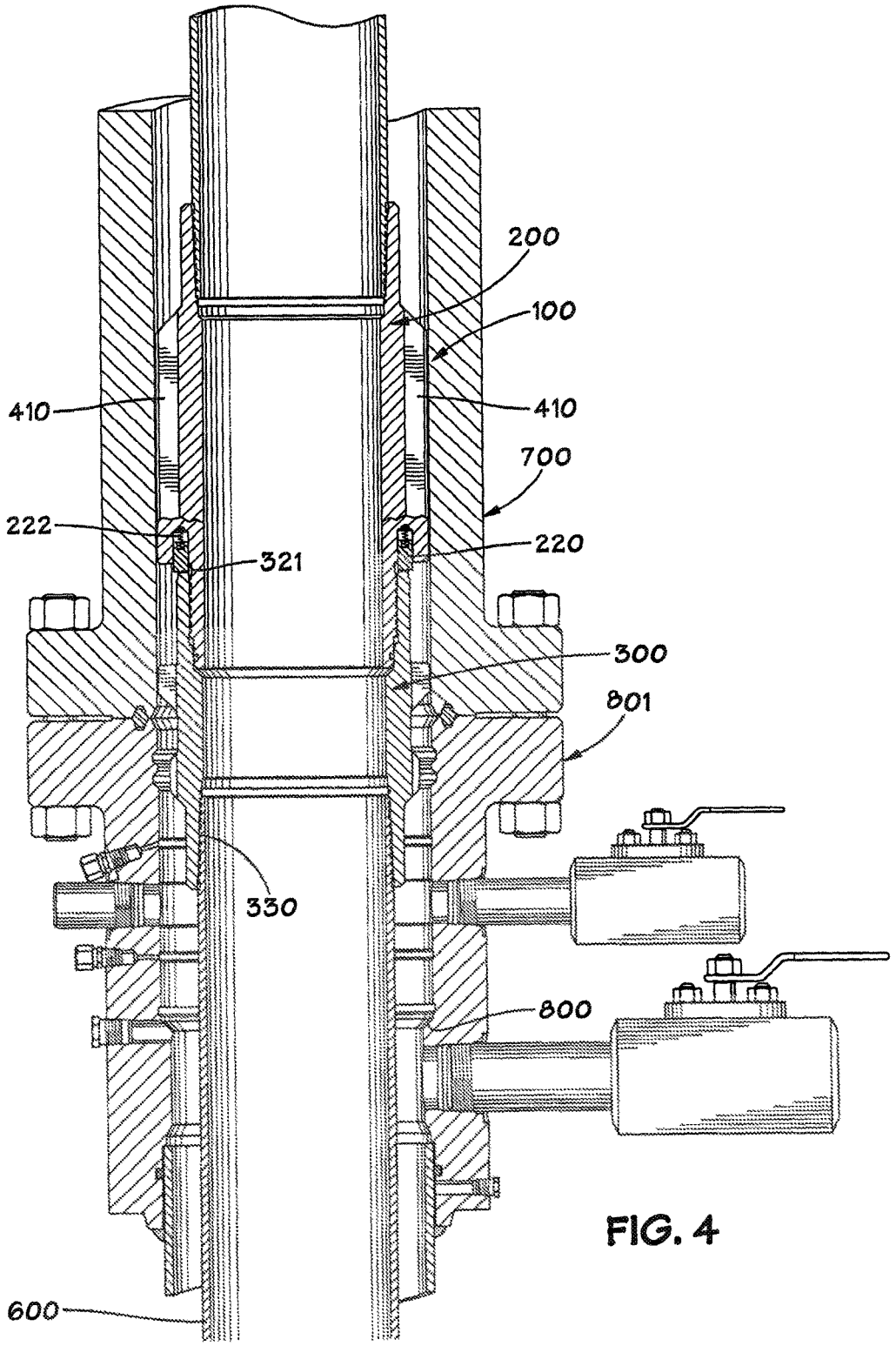
FIG. 4 is a partial cross-sectional view of the system of FIGS. 1-3 disposed within a wellhead housing.

A plurality of milled slots, or slots, 320 are preferably formed in the annular upper end surface 321 of the casing hanger 300 (FIGS. 1 and 2). The plurality of slots 320 are preferably radially spaced about the annular-shaped, upper end surface 321 of casing hanger 300, and preferably are equidistantly spaced from each other. For illustrative purposes, four slots 320 are provided, but a larger or smaller number of slots 320 may be used. Each of the slots 320 includes a vertically extending wall surface 322 and an angled, or beveled, wall surface 323, as shown in FIG. 2. Wall surfaces 322 are generally disposed in a coplanar relationship with the longitudinal axis of the system 100, which corresponds to line 3-3 of FIG. 1, and wall surfaces 323 are generally disposed in an angular, non-coplanar disposition with respect to the longitudinal axis of system 100. The running tool 200 has at least one, and preferably at least two or more, retractable, spring loaded, or spring biased, torque members, or torque pins, 220 which are outwardly biased by springs 222 within projection 206. Preferably, a torque pin, or pin, 220 is provided for each slot 320 provided in hanger 300. The torque pins, or pins, 220 are initially fixed within running tool 200, within openings 221 formed in the running tool 200 in a retracted configuration, with the springs 222 compressed, by use of retaining screws 230 (FIGS. 1 and 2), each of which are disposed within an opening 231 in the projection 206 of running tool 200. Upon rotation of the retaining screws 230, the springs 222 expand and the pins 220 move downwardly into their expanded configuration shown in FIGS. 1 and 2. A groove 235 (FIG. 2) is preferably formed in the at least one torque pin 220, and preferably in all of the torque pins 200. The grooves 235 cooperate with the tips 232 of the retaining screws 230 to initially frictionally engage and retain the torque pins 220 in their retracted configuration within openings 221, and thereafter align and guide the movement of each pin 220 within an opening 221 toward a slot 320, upon the retaining screws being backed out a sufficient distance to release the frictional engagement between grooves 235 and tips 232. The running tool 200 and casing hanger may be provided with a plurality of fluid bypass passageways 400 and 410 (FIGS. 1 and 4).

As shown in FIG. 2, each of the pins 220 has a vertically extending wall surface 223 which may be disposed adjacent, or abut, wall surface 322 of slots 320 in casing hanger 300, when pins 220 are in their expanded, slot-engaging configuration of FIG. 2. Each of the pins 220 also have an angled, or beveled wall surface 224 which may be disposed adjacent to, and generally conforms to the shape of, the angled, or beveled wall surface 323 of the slots 320 in casing hanger 300. Wall surfaces 223 are generally disposed in a coplanar relationship with the longitudinal axis of the system 100 and the wall surfaces 224 are generally disposed in an angular, non-coplanar disposition with respect to the longitudinal axis of system 100.

As will be hereinafter described in greater detail, the running tool 200 is attached to the casing hanger 300 with the right handed sets of threads 210, 310. Any torque generated from rotating the casing 600 to the right, or in a clockwise direction when viewed from the top of system 100, while running the casing hanger 300 is transmitted through the retractable, spring loaded pins 220 in the projection 206 of the running tool 200 to the vertical extending wall surfaces 322 of slots 320 in the annular-shaped, upper end surface 321 of the casing hanger 300.

To attach the running tool 200 to the hanger 300, the pins 220 are initially retracted up into the bottom of the projection 206 of the running tool 200 and held in place with the retaining screws 230. The running tool 200 is then screwed into the hanger 300 using the right hand Acme running threads 210, 310 until the running tool 200 and casing hanger 300 are brought to a positive stop. The pin retaining screws 230 are then backed out enough to permit the retainer screw tips 232 to release the frictional engagement between the retainer screw tips 232 and the grooves 235 in pins 220. The running tool 200 is then turned, or rotated, to the left, or counter-clockwise when viewed from the top of system 100, until the pins 220 spring biased downwardly into, or in engagement with, the slots 320 in the annular-shaped, upper wall surface 321 of the casing hanger 300.

The casing hanger and running tool system 100 is then made up into the casing 600, as by threading an end of the casing 600 into the set of threads 330 of the casing hanger 300. The system 100 and casing 600 are then run through the blowout preventer stack 700 (FIG. 4) to land the casing hanger 300 on the load shoulder 800 in the casing head, or well head housing, 801. If the casing 600 is rotated to the right, or clockwise when viewed from the top of system 100, while running the casing hanger 300, the vertical wall surfaces 223 of the running tool pins 220 engage with the slots 320 of the hanger 300, as by abutting the vertical wall surfaces 322 of slots 320, and transmit the torque directly from the pins 220 to the slots 320, therefore substantially bypassing the running tool threaded connection between threads 210 of running tool 200 and threads 310 of hanger 300. Once the hanger 300 is landed, the running tool 200 is rotated to the left, or counterclockwise when viewed from the top of system 100, thus unscrewing the running tool 200 from the casing hanger 300. The beveled wall surfaces 224 of the retractable pins 220 slide upwardly and over the beveled wall surfaces 323 of the slots 320 in the hanger body, so that as the running tool 200 rotates to the left, or counterclockwise when viewed from the top of system 100, the pins 220 will retract from the slots 320 back into the projection 206 of the running tool 200.

The use of the pins 220 of the running tool 200 with the slots 320 of the casing hanger 300 provides system 100 with a selectively engageable connection between the running tool 200 and casing hanger 300, whereby upon rotation of the casing hanger and running tool in a first, or clockwise direction, the casing or casing string may be rotated without any substantial tightening of the threaded connection between the running tool and the casing hanger, and upon rotation of the running tool in a second, or counterclockwise direction, the threaded connection between the running tool and the casing hanger may be disengaged.

Thus, if it is desired to rotate the casing 600, or a casing string, as for example, in highly deviated boreholes, resulting from horizontally directional drilling operations, it is possible to rotate the casing 600 in a clockwise, or right handed direction, when viewed from the upper end of the casing string, or system 100, in order to get the casing fully installed in the well. This right hand rotation may be obtained without applying an excessive amount of torque to, and without any substantial tightening of, the threaded connection, provided by the sets of threads 210, 310, between the running tool and the casing hanger, whereby they may later be easily disassembled, or disengaged, from one another after the casing 600, or casing string and casing hanger have been landed in the casing head.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure.

Use of broader terms such as comprises, includes, and having may be understood to provide support for narrower terms such as consisting of, consisting essentially of, and comprised substantially of. Accordingly, the scope of protection is not limited by the description set out above, but is defined by the claims that follow, that scope including all equivalents of the subject matter of the claims. Each and every claim is incorporated as further disclosure into the specification and the claims are embodiment(s) of the present disclosure.

While several embodiments have been provided in the present disclosure, it may be understood that the disclosed embodiments might be embodied in many other specific forms without departing from the spirit or scope of the present disclosure and the appended claims. The present examples are to be considered as illustrative and not restrictive, and the intention is not to be limited to the details given herein. For example, the various elements or components may be combined or integrated in another system or certain features may be omitted, or not implemented.

In addition, the various embodiments described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

I claim:

1. A casing hanger and running tool system, comprising:

a casing hanger having an upper and a lower end, an annular-shaped, upper wall surface and a first set of internal threads disposed adjacent the lower end of the casing hanger, first of internal threads adapted to receive a threaded end of a length of casing, and a second set of internal threads disposed on an inner wall surface of the casing hanger, adjacent the upper end of the casing hanger;

a running tool having an upper and a lower end, including an annular-shaped projection disposed intermediate the upper and lower ends of the running tool, a set of external threads disposed on an outer wall surface of the running tool, the set of external threads of the running tool being releasably engageable with the second set of internal threads of the casing hanger when the running tool is received within the casing hanger, to provide a threaded connection between the running tool and the casing hanger; and a selectively engageable connection between the casing hanger and the running tool, associated with the annular-shaped projection of the running tool and the annular-shaped, upper wall surface of the casing hanger, the selectively engageable connection includes at least one pin member disposed within the annular-shaped projection of the running tool, and at least two slots formed in the annular-shaped, upper wall surface of the casing hanger, and the at least one pin member is engageable with one of the at least two slots, wherein the at least one pin member has a vertically extending wall surface and a beveled wall surface, each of the at least two slots has a vertically extending wall surface and a beveled wall surface, and when the at least one pin member is disposed within one of the at least two slots, the vertically extending wall surface of the at least one pin member is disposed adjacent the vertically extending wall surface of one of the at least two slots, and the beveled wall surface of the at least one pin member is disposed adjacent the beveled wall surface of one of the at least two slots, whereby upon rotation of the casing hanger and running tool in a first direction, the length of casing may be rotated without any substantial tightening of the threaded connection between the running tool and the casing hanger, and upon rotation of the running tool in a second direction, the threaded connection between the running tool and the casing hanger is disengaged.

2. The casing hanger and running tool system of claim 1, wherein the at least one pin member is at least two pin members disposed within the annular-shaped projection of the running tool, and the at least two pin members are spring biased to extend outwardly of the annular-shaped projection of the running tool into engagement with at least two of the slots formed in the annular-shaped, upper wall surface of the casing hanger.

3. The casing hanger and running tool system of claim 1, wherein at least one retaining screw is associated with the annular-shaped projection of the running tool for the at least one pin member, and the at least one retaining screw releasably retains the at least one pin member within the annular-shaped projection of the running tool.

4. The casing hanger and running tool system of claim 1, wherein the running tool and the casing hanger include a plurality of fluid bypass passageways.

5. A method for rotating a casing string in a borehole, comprising:

providing a casing hanger and running tool system, including: a casing hanger having an upper and a lower end, an annular-shaped, upper wall surface and a first set of internal threads disposed adjacent the lower end of the casing hanger, and a second set of internal threads disposed on an inner wall surface of the casing hanger; a running tool having an upper and a lower end including an annular-shaped projection disposed intermediate the upper and lower ends of the running tool, and a set of external threads disposed on an outer wall surface of the running tool, and a selectively engageable connection between the casing hanger and the running tool associated with the annular-shaped projection of the running tool and the annular-shaped, upper wall surface of the casing hanger and having at least one pin member disposed within the annular-shaped projection of the running tool, and at least two slots associated with the annular-shaped upper, wall surface of the casing hanger, and the at least one pin member engaging with one of the at least two slots, the at least one pin member having a vertically extending wall surface and a beveled wall surface, each of the at least two slots having a vertically extending wall surface and a beveled wall surface, and when the at least one pin member is disposed within one of the at least two slots, the vertically extending wall surface of the at least one pin member is disposed adjacent the vertically extending wall surface of one of the at least two slots, and the beveled wall surface of the at least one pin member is disposed adjacent the beveled wall surface of one of the at least two slots;

attaching the running tool to the casing hanger by disposing the running tool within the casing hanger and providing relative rotational movement between the running tool and the casing hanger to releasably engage the set of external threads of the running tool with the second set of internal threads of the casing hanger to provide a threaded connection between the running tool and the casing hanger;

engaging the selectively engageable connection between the casing hanger and the running tool;

attaching the casing string to the casing hanger and running tool system by disposing an end of the casing string within the first set of internal threads disposed adjacent the lower end of the casing hanger; and providing a rotational force to the casing hanger and running tool to rotate the casing string without substantially tightening the threaded connection between the running tool and the casing hanger by transmitting the rotational force through the selectively engageable connection.

6. The method of claim 5, including providing at least two pin members, for the at least one pin member, within the annular-shaped projection of the running tool, and spring biasing the at least two pin members to extend outwardly of the annular-shaped projection of the running tool into engagement with at least two of the slots which are associated with the annular-shaped, upper wall surface of the casing hanger.

7. The method of claim 5, including providing at least one retaining screw associated with the annular-shaped projection of the running tool for the at least one pin member, and releasably retaining the at least one pin member within the annular-shaped projection of the running tool with the at least one retaining screw.

8. The method of claim 5, including providing the running tool and the casing hanger with a plurality of fluid bypass passageways.

9. A casing hanger and running tool system, comprising:

a casing hanger having an upper and a lower end, an annular-shaped, upper wall surface and a first set of internal threads disposed adjacent the lower end of the casing hanger, first of internal threads adapted to receive a threaded end of a length of casing, and a second set of internal threads disposed on an inner wall surface of the casing hanger, adjacent the upper end of the casing hanger;

a running tool having an upper and a lower end, including an annular-shaped projection disposed intermediate the upper and lower ends of the running tool, a set of external threads disposed on an outer wall surface of the running tool, the set of external threads of the running tool being releasably engageable with the second set of internal threads of the casing hanger when the running tool is received within the casing hanger, to provide a threaded connection between the running tool and the casing hanger; and a selectively engageable connection between the casing hanger and the running tool, associated with the annular-shaped projection of the running tool and the annular-shaped, upper wall surface of the casing hanger, the selectively engageable connection includes at least one pin member disposed within the annular-shaped projection of the running tool, and at least two slots formed in the annular-shaped, upper wall surface of the casing hanger, and the at least one pin member is engageable with one of the at least two slots, wherein at least one retaining screw is associated with the annular-shaped projection of the running tool for the at least one pin member, and the at least one retaining screw releasably retains the at least one pin member within the annular-shaped projection of the running tool, whereby upon rotation of the casing hanger and running tool in a first direction, the length of casing may be rotated without any substantial tightening of the threaded connection between the running tool and the casing hanger, and upon rotation of the running tool in a second direction, the threaded connection between the running tool and the casing hanger is disengaged.

10. The casing hanger and running tool system of claim 9, wherein the at least one pin member is at least two pin members disposed within the annular-shaped projection of the running tool, and the at least two pin members are spring biased to extend outwardly of the annular-shaped projection of the running tool into engagement with at least two of the slots formed in the annular-shaped, upper wall surface of the casing hanger.

11. The casing hanger and running tool system of claim 9, wherein the running tool and the casing hanger include a plurality of fluid bypass passageways.

12. The casing hanger and running tool system, of claim 9, wherein the at least one pin member has a vertically extending wall surface and a beveled wall surface, each of the at least two slots has a vertically extending wall surface and a beveled wall surface, and when the at least one pin member is disposed within one of the at least two slots, the vertically extending wall surface of the at least one pin member is disposed adjacent the vertically extending wall surface of one of the at least two slots, and the beveled wall surface of the at least one pin member is disposed adjacent the beveled wall surface of one of the at least two slots.

* * * * *